United States Patent [19]

Rogers

[11] 3,978,688

[45] Sept. 7, 1976

[54] FOLDING HANDLES FOR THE CARRIAGE OF A FLAT BED KNITTING MACHINE

[75] Inventor: Howard David Rogers, Fanwood, N.J.

[73] Assignee: The Singer Company, New York, N.Y.

[22] Filed: Mar. 26, 1976

[21] Appl. No.: 670,793

[52] U.S. Cl. ..... 66/60

[51] Int. Cl.[2] ..... D04B 7/00

[58] Field of Search ..... 66/60, 604, 64, 78, 66/66, 1 R

[56] References Cited

UNITED STATES PATENTS

| | | | |
|---|---|---|---|
| 2,759,343 | 8/1956 | Schurich | 66/60 |
| 3,120,114 | 2/1964 | Sasaki | 66/60 |
| 3,735,607 | 5/1973 | Jewey | 66/60 |

FOREIGN PATENTS OR APPLICATIONS

| | | | |
|---|---|---|---|
| 703,793 | 2/1941 | Germany | 66/60 |

*Primary Examiner*—Ronald Feldbaum

*Attorney, Agent, or Firm*—Edward L. Bell; Robert E. Smith; William V. Ebs

[57] ABSTRACT

The carriage of a flat bed knitting machine is provided with pivoted handles movable between a folded and a generally upright position and in their folded positions the handles hold the carriage against longitudinal motion in a defined position on the needle bed.

8 Claims, 7 Drawing Figures

FOLDING HANDLES FOR THE CARRIAGE OF A FLAT BED KNITTING MACHINE

BACKGROUND OF THE INVENTION

1. Field of the Invention

The invention relates to flat bed knitting machines and more particularly to handles for the carriage of such a machine.

2. Description of the Prior Art

The carriage of an industrial flat bed knitting machine and especially a home type flat bed knitting machine is commonly provided with a handle which an operator can use to move the carriage on the needle bed. It is well known as indicated in the following Japanese U.M. Publications for the handle to be pivotally mounted in a generally upright position on the carriage:

| | |
|---|---|
| U.M. Publication | 4168/64 |
| " | 24122/65 |
| " | 25737/65 |
| " | 24121/65 |
| " | 12755/66 |
| " | 16851/67 |

Having the handle pivotally mounted on the carriage permits an operator to dispose the handle in a generally upright position when he wishes to use it to move the carriage and to dispose the handle in a folded out-of-the-way position on the carriage after he had finished moving the carriage.

SUMMARY OF THE INVENTION

In accordance with the invention the carriage of a flat bed knitting machine is provided with a pivotally mounted handle which is not only movable between a folded and a more upright position but is adapted to engage sinkers on the needle bed in the folded position and hold the carriage against longitudinal motion in a defined position on the needle bed. In addition means are provided for securely holding the handle in its folded position and for locking the handle in its more upright position.

DESCRIPTION OF THE PREFERRED EMBODIMENT

Figure 1:
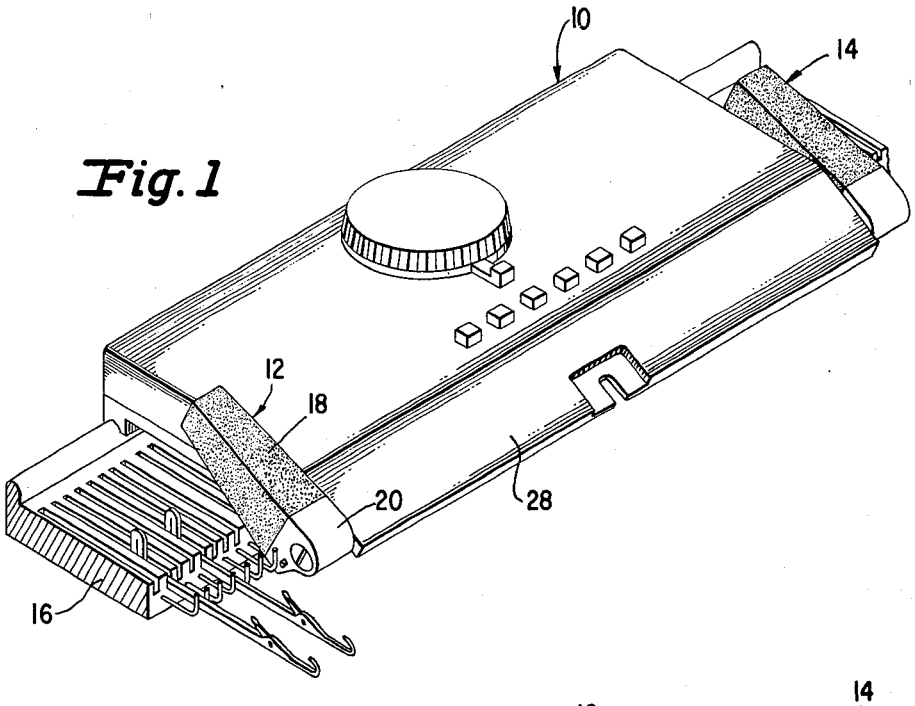
FIG. 1 is a perspective view of the carriage of a knitting machine with handles according to the invention in a folded position.
Figure 2:
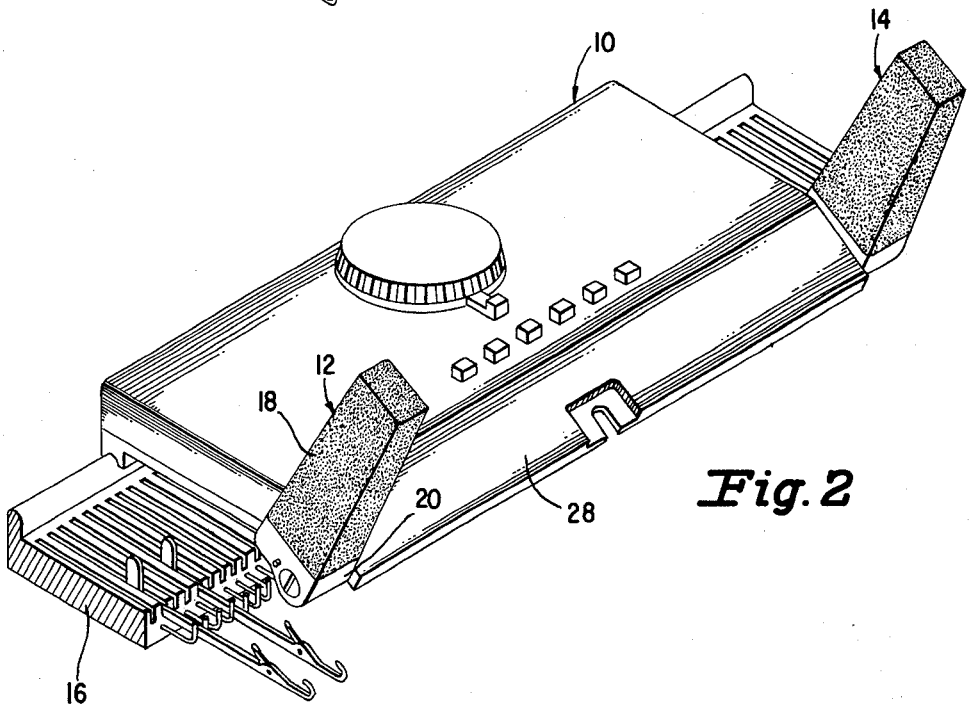
FIG. 2 is a view similar to FIG. 1 showing the handles in their upright position.

Referring to the drawings, reference character 10 designates the carriage of a flat bed knitting machine. As shown, the carriage is provided at opposite ends with handles 12 and 14 which an operator may use to move the carriage back and forth across a needle bed 16 of the machine during knitting. The handles are alike and each is mounted on the carriage in the same manner for movement between a folded (FIG. 1) and an upright position (FIG. 2). Since the handles are alike and are mounted in the same manner only one handle (handle 12) and the mounting of such handle is hereinafter described in detail.

As shown handle 12 includes a portion 18 which may be grasped by an operator, and a base 20 to which portion 18 is secured, the portion 18 being mounted on a pin 21 screwed into the base at 22 and being cemented to the base by a suitable adhesive at contacting surfaces 24 and 26. Preferably the base 20 is metal and handle portion 18 is of hard rubber or a synthetic plastic material.

The base 20 of handle 12 is pivotally mounted on the frame 28 of the carriage by means of a pin 30 having threads 32 at one end which screw into a threaded hole 34 in the frame 28. The opposite end of the pin has a slot 36 for receiving the end of a screw driver which may be used to tightly affix the pin in the frame when assembling the handle and carriage or to remove the pin and handle from the carriage.

Figure 3:
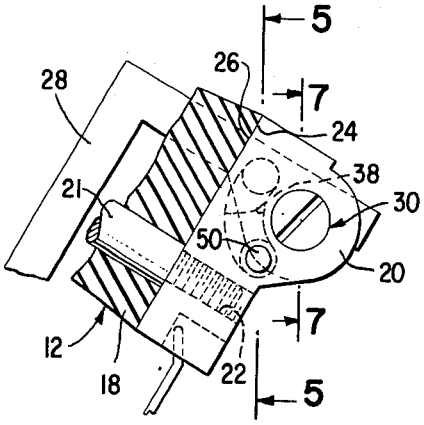
FIG. 3 is an enlarged end view partially in section showing a handle of the invention in a folded position.
Figure 4:
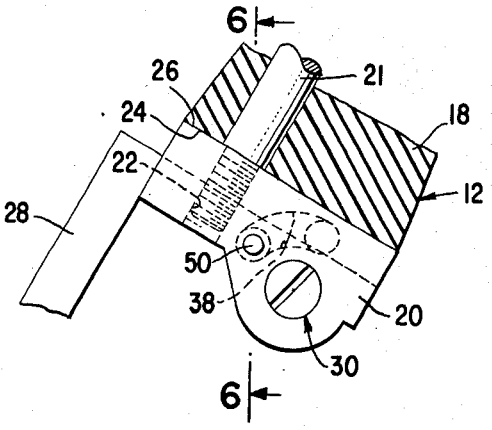
FIG. 4 is a view similar to FIG. 3 showing the handle in its upright position.

The base 20 is provided with an arcuate ramp 38 to engage a spring biased pin 40 which is mounted in the frame 28 of the carriage. As shown the pin 40 is located in a hole 42 in frame 28 and is biased outwardly into contact with ramp 38 by coil spring 44. At one end of the ramp 38 there is a hole 46 which extends into the base and registers with pin 40 when the handle 12 is moved into the upright position (FIGS. 4 and 6). At such times pin 40 is caused by spring 44 to enter hole 46 and lock the handle in position. Hole 46 contains an unlocking pin 48 which contacts pin 40 to limit the movement of pin 40 into the hole. If pin 48 is depressed until its outer end 50 is flush with surface 52 of the base, pin 40 is moved against the bias of spring 44 to the top of ramp 38 thereby unlocking the handle and permitting it to be pivoted around pin 30 to the folded position of FIG. 1. Pin 40 engages the deep end of ramp 38 in the folded position of the handle (FIGS. 3 and 5), and the pressure of the pin on the ramp tends to maintain the handle in such folded position until purposely moved from the folded position by an operator.

Figure 5:
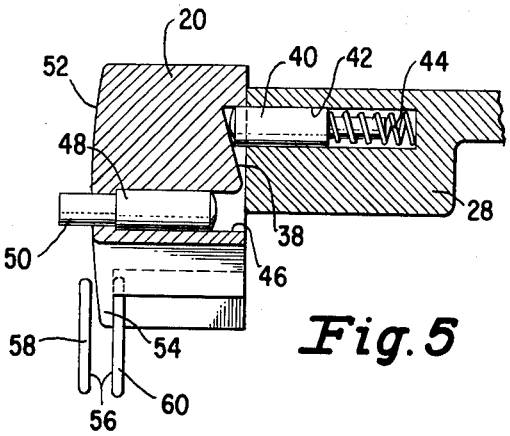
FIG. 5 is a sectional view taken on the plane of the line 5—5 of FIG. 3.
Figure 6:
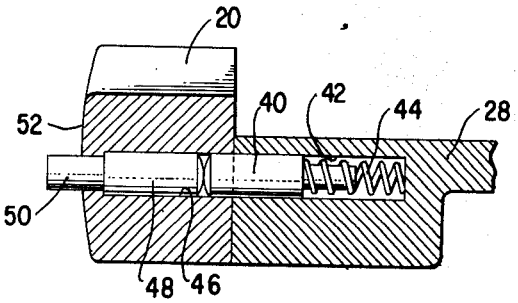
FIG. 6 is a sectional view taken on the plane of the line 6—6 of FIG. 4.
Figure 7:
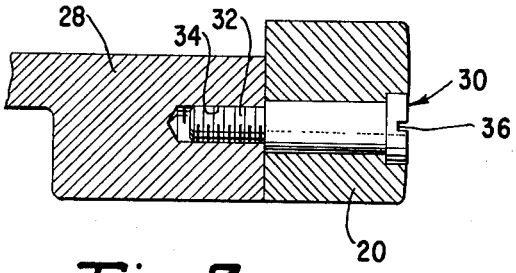
FIG. 7 is a sectional view taken on the plane of the line 7—7 of FIG. 3.

In the folded position of the handle 12 a flange 54 on the base 20 enters a space 56 between adjacent sinkers 58 and 60 on the bed of the machine and holds the carriage against longitudinal motion in a defined position on the needle bed (FIG. 5). The longitudinal spacing between the handles 12 and 14, which as previously noted are similarly constructed, is such that whenever both handles are folded and flange 52 on the base of handle 12 is disposed in a space between adjacent sinkers, a like flange on the base of handle 14 is also disposed in a space between adjacent sinkers.

While the handles 12 and 14 as illustrated are individually movable by an operator between a folded and more upright position it is to be understood that they could be mounted on a common shaft and thereby be constructed to move in unison. It is to be further understood that other changes in the preferred form of the invention which have been described herein with a certain degree of particularity might also be made in the details of construction and in the combination and arrangement of parts without departing from the spirit and scope of the invention as set forth in the appended claims.

Having thus set forth the nature of the invention, what is claimed herein is:

1. In a flat bed knitting machine which includes a needle bed with sinkers along the outer longitudinal edge thereof and a carraige slidable on the bed, the combination comprising a handle, means pivotally mounting the handle on the carriage for movement between a folded and more upright position, and means movable with the handle to engage sinkers in the folded position of the handle and hold the carriage against longitudinal motion in a defined position on the needle bed.

2. The combinaion of claim 1 wherein the handle folds rearwardly relative to the carriage and needle bed.

3. The combination of claim 1 including means for holding the handle in its folded position.

4. The combination of claim 3 wherein the means for holding the handle in its folded position includes an arcuate ramp on the handle, a pin in the carriage and spring means for biasing the pin against said arcuate ramp.

5. The combination of claim 1 including means for locking the handle in the said more upright position.

6. The combination of claim 5 wherein the locking means includes a pin in the carriage, a hole in the handle registrable with the pin in the said more upright position of the handle and spring means for pushing the pin into the hole in the handle.

7. The combination of claim 6 including means for forcing the pin from the hole in the handle to unlock the handle such that it may be moved toward its folded position.

8. The combination of claim 1 including means for holding the handle in its folded position and for locking the handle in the said more upright position.

* * * * *